United States Patent [19]

Lyman, Jr.

[11] 3,967,653

[45] July 6, 1976

[54] HARNESS SUPPORT AND LINKAGE

[75] Inventor: Merton C. Lyman, Jr., Woodstock, Conn.

[73] Assignee: Rockwell International Corporation, Pittsburgh, Pa.

[22] Filed: June 23, 1975

[21] Appl. No.: 589,440

[52] U.S. Cl. ..... 139/88; 139/84

[51] Int. Cl.[2] ..... D03C 13/00

[58] Field of Search ..... 139/82, 83, 84, 87, 139/88, 55, 79

[56] References Cited

UNITED STATES PATENTS

| | | | |
|---|---|---|---|
| 2,522,625 | 9/1950 | Lundgren | 139/88 |
| 2,640,506 | 6/1953 | Consoletti | 139/88 |
| 3,241,574 | 3/1966 | Kramer | 139/88 |

FOREIGN PATENTS OR APPLICATIONS

| | | | |
|---|---|---|---|
| 47-34674 | 8/1972 | Japan | 139/82 |
| 480,465 | 12/1969 | Switzerland | 139/88 |
| 713,185 | 8/1954 | United Kingdom | 139/84 |

*Primary Examiner*—James Kee Chi

[57] ABSTRACT

An improved support for loom harness frames comprising a mounting base for attachment to the frame, a connecting link to engage the loom dobby, a harness return bar, and separate means joining the base, the connecting link and the return bar which are of lengths substantially no greater than the combined thicknesses of the elements being joined.

6 Claims, 6 Drawing Figures

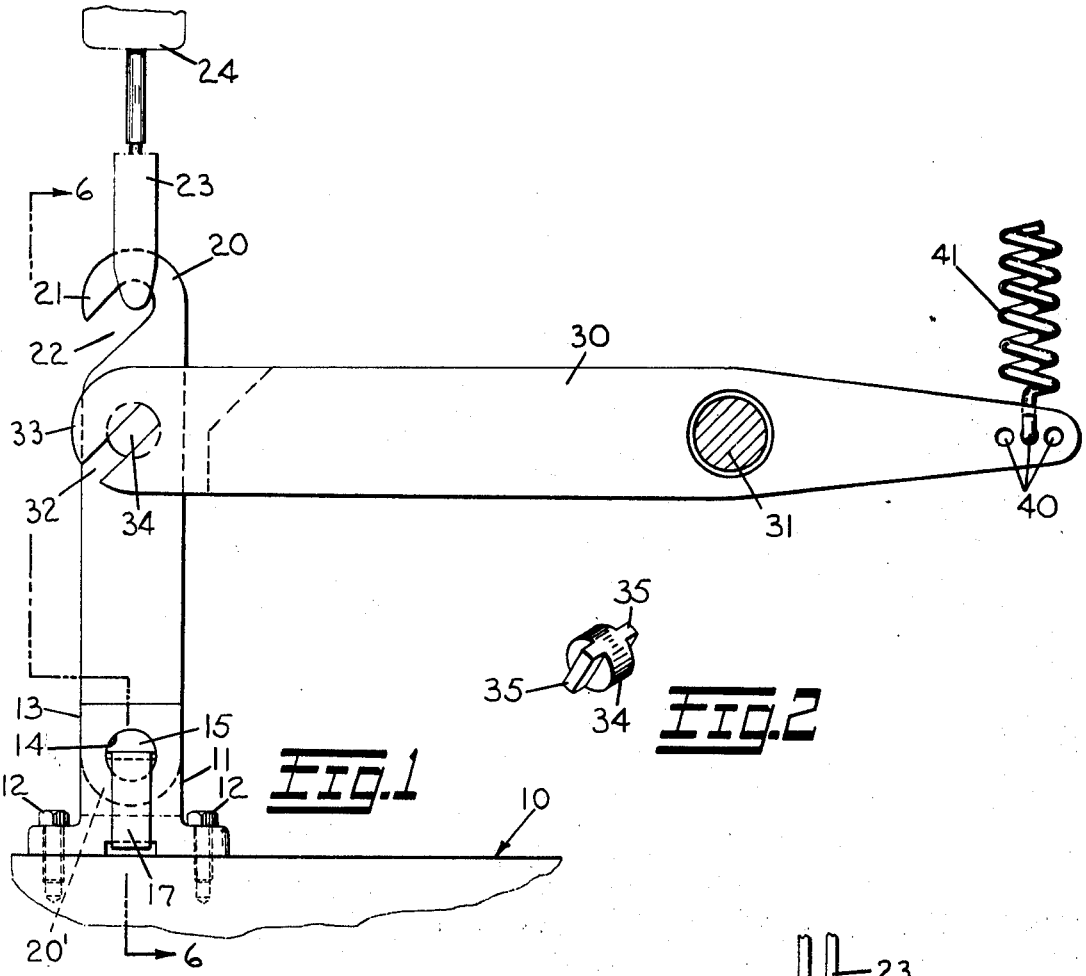
Fig. 1
Fig. 2
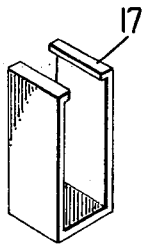
Fig. 3
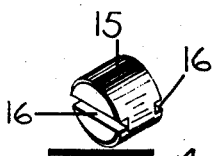
Fig. 4
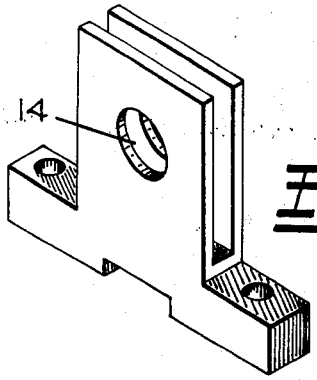
Fig. 5
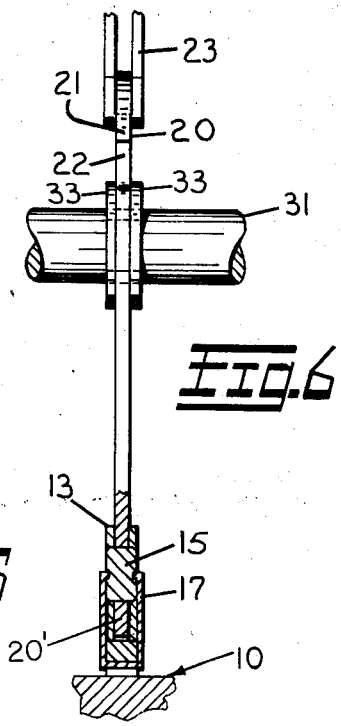
Fig. 6

HARNESS SUPPORT AND LINKAGE

BACKGROUND OF THE INVENTION

It is well known that the weaving process necessarily involves the use of loom apparatuses and processes whereby the warp yarns are controlled to form sheds through which the weft is inserted, beat up by the loom reed and then locked into position by warp reversal. The warp yarns are controlled by means of heddles mounted within harness frames, the frames being moved between upper and lower positions by suitable driving means. In the most simple weaving arrangement there are only two harness frames, each frame controlling a preselected number, usually half, of the warp yarns. To produce more intricate weaving patterns, larger numbers of harness frames are used so that the number of warp yarns controlled by any given frame is less than the number that would usually be controlled in the simple two harness construction.

It is also known that loom harnesses may be moved between upper and lower positions by either positive or negative drive means. The positive driving method means that the harnesses are actively moved in two directions by a positive driving mechanism whereas in the negative method the harnesses are driven positively in one direction and then returned to the original position by means of biasing springs, or equivalent motivating elements. Most commonly, in loom negative dobby applications, the frames are moved to the upper position by means of a loom dobby that is connected to the upper rail of each frame. The return biasing means is appropriately connected to the bottom rail of each frame. Thus, when the dobby moves a frame to the upper position, the lower biasing means is tensioned so that it can return the frame to its lower position upon relaxation of the dobby pull.

Although various loom negative dobby systems generally have been used widely and found useful for many applications, there exist inherent limitations. Specifically as loom speed has been increased to achieve greater loom productivity it has been necessary to increase the strength of the biasing means. This increase in strength has, in turn, caused the harness frames to be placed in extreme tension and the result has been bowing of the frame, with the consequent undesirable side effects. Strengthening of all of the interrelated parts has meant increases in the sizes of the parts and these increases in sizes have restricted the number of loom harnesses that could be used on any given loom. Also, change or repair of a loom harness has caused excessive down time of the loom because the connections to the harnesses were not capable of being easily disconnected.

OBJECTS OF THE INVENTION

It is therefore a principal object of this invention to provide an improved support for harness frames in loom negative dobby applications such that the harnesses are not subjected to damaging tensile stresses.

Another object of this invention is to provide an improved loom harness support in which the support members for the harness are of no greater thickness than the harness frame, thus permitting a greater number of loom harnesses in a given space than has heretofore been possible.

An additional object of this invention is to provide an improved loom harness support in which the harnesses are operated from only one of the two horizontal harness frame members.

These and other objects of this invention will be in part obvious and in part explained by reference to the accompanying specification and drawings in which:

DESCRIPTION OF THE DRAWINGS

FIG. 1 is a side elevation of the improved support of this invention showing a portion of the dobby pull cable and a portion of the top rail of the harness frame;

FIG. 2 is a perspective view of the pivot pin that is used to connect the two operative links shown in FIG. 1;

FIG. 3 is a perspective view of a retaining clip that is used to attach the vertical link of FIG. 1 to the base member that is attached to the harness frame;

FIG. 4 is a perspective view of the pivot pin used in conjunction with the same connection as the clip FIG. 3;

FIG. 5 is a perspective view of the mounting base that is used to connect the connecting link to the harness frame; and FIG. 6 is a view taken along the line 6—6 of FIG. 6.

DESCRIPTION OF THE INVENTION

It has herein, previously been stated that the present invention makes possible the mounting of a greater number of loom harnesses within a more compact area than has been possible with previous harness supports. Additionally, since the operating forces to move the harnesses between their upper and lower positions are effected from one side only the tensile stresses to which harnesses were formerly subjected has also been eliminated. For a better understanding of the invention reference is made to FIG. 1 of the drawings in which the numeral 10 indicates a portion of the upper, horizontal rail of a harness frame. It can be seen that there is a mounting base 11 that has been attached to the upper rail by means of a pair of threaded fasteners 12 that thread directly into the upper portion of the rail 10. Mounting base 11 includes an upwardly extending flange 13, which in this case is actually constituted of a pair of upstanding members. Through the flange 13 there is a circular opening 14, best seen in FIG. 5 of the drawings, which receives the pivot pin 15 shown in FIG. 2 of the drawings. It will be noted that, referring to FIG. 4 of the drawing, the pivot pin 15 is substantially cylindrical in shape and has a pair of slotted openings 16 on each side thereof which receive the pin clip 17 shown in FIG. 3 of the drawings. It is the function of the pin clip to hold the clip extends completely around the bottom of base 11 through an opening formed by removing a small portion of the base which would normally contact the upper rail 10 of the harness frame.

The next element in the improved support of this invention is the connecting link 20 having means at one end to mate with the flange 13 of mounting base 11. This means comprises an end 20' that interfits with the flange 13 of base 11. The end 20' includes a circular opening which extends therethrough and which can be brought into registry with the opening 14 of flange 13.

The other end of connecting link 20 includes means for connecting the link to the dobby. In this case the means comprises a hook like portion 21 that defines a recess 22 for receiving the connecting link 23 of the dobby pull cable 24.

To effect upward and downward movement of the connecting link 20 and thereby the harness frame 10, the improved support also includes a harness return bar 30 that is disposed substantially horizontally and which is mounted for pivot movement about a shaft 31 that is connected directly to the frame of the loom. The inner end of harness return bar 30, i.e. that end adjacent to the connecting link 20 has means providing for a simple, easily disassembled connection with the connecting link 20. This means comprises an upwardly and rearwardly directed slot of lesser diameter than the diameter of the opening that is present in the connecting link 20. The numeral 32 identifies this upwardly and rearwardly extending slot which is formed by the hook like overhand portion 33 on the end of harness return bar 30.

The connecting link 20 has an opening extending therethrough, in the vicinity of slot 22, to receive a pivot pin 34 that enables connection between the connecting link and harness return bar 30. The pivot pin 34 has extensions 35 protruding outwardly from each side thereof which are of approximately the same thickness as that of the slot 32 formed by overhang 33. This combination provides a simple yet effective means for connecting members 20 and 30, and one which can be readily disconnected.

The other end of harness return bar 30 is provided with a plurality of openings 40 into which can be hooked a spring or other suitable biasing means 41 that is to be used to return the harness and the remainder of the dependent support mechanism to the lower position when the dobby pull cable 24 no longer is overcoming the return pull of spring 41.

It can be seen by referring to the drawings that the only connections made to the harness frame 10 are those which operate through the support base 11 that is secured to the frame 10 by means of threaded fasteners 12. When it is desired to form a shed with certain of the warp yarns the appropriate dobby pull cable 24 will be actuated upwardly and the harness return bar 30 pivoted in a clockwise direction about shaft 31. This action of course stretches the coil spring 41 causing it to exert a greater pull against the outer end of bar 30. When the dobby pull cable returns to its original position then the action of coil spring 41 will result in counterclockwise movement of bar 30 about the axis of shaft 31, permitting the connecting link 20 and the frame 10 to return to its lowermost position.

In the event that it is desired to completely remove a harness frame it is necessary only to move the outwardly extending ears of pin 34 down and out of the slot 32 so that the spring 41 no longer exerts its biasing influence. Once this constraining influence is removed, then the entire harness frame assembly can be moved upwardly so that the hook portion 21 clears the connector 23 and the harness is easily removed from the loom.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. An improved support for harness frames on a loom in which the harnesses controlling the warp yarns are actuated by a loom dobby, said support comprising:

a. a mounting base secured to the upper rail of the harness frame, said base including an upwardly extending flange having a circular opening extending therethrough.

b. a connecting link having i. means at one end to mate with the said flange of said mounting base and having a circular opening extending therethrough which can be brought into registry with the opening in said flange, ii. means at the other end for connecting said link to the loom dobby; and, iii. means intermediate the ends of said link defining an opening adapted to receive a rotatable connecting pin.

c. a pivot pin mounted within said circular openings in said mounting base flange and in said one end of said connecting link to join said link to said base and to provide a pivot axis for said link.

d. means mounted on the loom to provide a pivot axis extending in a direction substantially parallel to the warp yarn.

e. a harness return bar mounted intermediate its inner and outer ends on said pivot axis means so that its inner end overlaps said connecting link, said return bar including:

i. means at its inner end defining an opening that is in registry with said opening intermediate the ends of said link.

f. a pivot pin connecting said link with said harness return bar, and g. biasing means attached to the outer end of said harness return bar and to the loom for continuously urging said outer end in an upward direction.

2. An improved support as defined in claim 1 wherein said pivot pin joining said link to said base and said pivot pin connecting said link with said harness return bar are of lengths no longer than the combined total thicknesses of the members being connected.

3. An improved support as defined in claim 1 wherein said means for connecting said link to the loom dobby comprises a hook-like portion that forms a connecting recess.

4. An improved support as defined in claim 1 wherein the opening on the inner end of said harness return bar is an upwardly and rearwardly directed slot of lesser width than the diameter of the opening present in said connecting link intermediate the ends thereof.

5. An improved support as defined in claim 1 wherein said mounting base is provided with a recess in its surface that is in contact with the rail of the harness frame.

6. An improved support as defined in claim 5 wherein a generally U-shaped spring clip extends through said recess and engages said pivot pin joining said connecting link to said base to hold said pivot pin in position.

* * * * *